United States Patent [19]

Van Rogue

[11] Patent Number: 4,865,381

[45] Date of Patent: Sep. 12, 1989

[54] SUNSHADE ATTACHMENT

[76] Inventor: JoBaire V. Van Rogue, 6715 1/4 Tenth Ave., Los Angeles, Calif. 90043

[21] Appl. No.: 226,875

[22] Filed: Aug. 1, 1988

[51] Int. Cl.[4] ..... A47C 7/10

[52] U.S. Cl. ..... 297/184; 135/96; 135/DIG. 9

[58] Field of Search ..... 135/96, DIG. 9, 118, 135/101, 90; 297/184

[56] References Cited

U.S. PATENT DOCUMENTS

| | | | |
|---|---|---|---|
| 1,919,110 | 7/1933 | Horvath | 297/184 X |
| 4,230,363 | 10/1980 | Borichevsky | 297/184 |
| 4,295,481 | 10/1981 | Gee | 297/184 X |

FOREIGN PATENT DOCUMENTS

| | | | |
|---|---|---|---|
| 1126796 | 7/1956 | France | 297/184 |
| 1490621 | 1/1967 | France | 135/96 |

*Primary Examiner*—James T. McCall

[57] ABSTRACT

An improved sunshade attachment comprising a first generally U-shaped member releasably securable to a pair of clamps for attaching the sunshade to a desired structure, a second generally U-shaped canopy supporting member releasably attachable to said first U-shaped member, a pair of side arms interposable between said first and second U-shaped members, a canopy for covering said members and providing shade to an area beneath said canopy, and a pair of coil-type screens mountable on either side of said sunshade and extensible to provide lateral protection and privacy.

7 Claims, 3 Drawing Sheets

SUNSHADE ATTACHMENT

BACKGROUND

1. Field of Invention

This invention relates to sunshades and is particularly directed to sunshade attachments for folding chairs, chaise lounges, golf carts and the like.

2. Prior Art

Millions of people each day spend time sunbathing—relaxing in the back yard or at the beach, lounging at a campsite or on a cruise, driving a golf cart or wheel chair, etc. Unfortunately, people have recently started to become seriously concerned about getting too much sun, with the possibility of developing freckles, skin cancers or other problems. Consequently, people have begun to seek ways to limit their exposure to their sun, while still being able to enjoy the various sun activities. As a result, lounge chairs have been proposed which have sunshades provided as permanent parts of such chairs. Alternatively, sunshade attachments have been proposed heretofore which could be added to existing chair. However, the prior art sunshade attachments have been severely limited in utility and have been designed for use only with a given type of chair.

A search in the U.S. Patent Office has revealed the following patents:

| U.S. Pat. No. | INVENTOR | ISSUE DATE |
|---|---|---|
| 4,230,363 | D. B. Borichevsky | Oct. 28, 1980 |
| 4,300,798 | D. E. Musgrove et al | Nov. 17, 1981 |
| 4,639,036 | J. O. Nichols | Jan. 27, 1987 |

The patent to Borichevsky discloses a lounge chair having a sunshade provided as a permanent part thereof. This is apparent from the fact that each of Borichevsky's claims recites the chair structure as a part of his invention. Furthermore, Borichevsky's clamps 26, which permit tilting adjustment of the sunshade, also serve to attach the sunshade to the chair. Consequently, if the clamps 26 are loosened to adjust the tilt of the sunshade, the sunshade is subject to undesired slippage at the same time and may even become separated from the chair. This disadvantage is overcome with the present invention. The patents to Musgrove and Nichols disclose sunshade structures which are clearly permanent parts of the chairs and are limited to use with this particular type of chair. Thus none of the prior art sunshade attachments have been entirely satisfactory.

These disadvantages of the prior art are overcome with the present invention and an improved sunshade attachment is provided which can be quickly and easily attached to substantially any existing lounge chair or the like and which can be adjusted simply and easily without effecting the attachment mechanism. Furthermore, the sunshade of the present is readily adaptable to either chairs or chaise lounges and is equally useful with golf carts, wheel chairs and the like. In addition, the sunshade attachment of the present invention also provides lateral protection against sunlight coming from the side and enables the user to provide himself with a measure of privacy, if desired.

The advantages of the present invention are preferably attained by providing an improved sunshade attachment comprising a first generally U-shaped member releasably securable to a pair of clamps for attaching the sunshade to a desired structure, a second generally U-shaped canopy supporting member releasably attachable to said first U-shaped member, a pair of side arms interposable between said first and second U-shaped members, a canopy for covering said members and providing shade to an area beneath said canopy and a pair of coil-type screens mountable on either side of said sunshade and extensible to provide lateral protection and privacy.

Accordingly, it is an object of the present invention to provide an improved sunshade attachment.

Another object of the present invention is to provide an improved sunshade attachment which is readily adaptable to a variety of supporting structures.

An additional object of the present invention is to provide an improved sunshade attachment which is quickly and easily adaptable to either chairs or chaise lounges and the like.

A further object of the present invention is to provide a sunshade attachment which provides protection against both overhead and lateral sunlight.

A specific object of the present invention is to provide an improved sunshade attachment comprising a first generally U-shaped member releasably securable to a pair of clamps for attaching the sunshade to a desired structure, a second generally U-shaped canopy supporting member releasably attachable to said first U-shaped member, a pair of side arms interposable between said first and second U-shaped members, a canopy for covering said members and providing shade to an area beneath said canopy, and a pair of coil-type screens mountable on either side of said sunshade and extensible to provide lateral protection and privacy.

These and other objects and features of the present invention will be apparent from the following detailed description, taken with reference to the figures of the accompanying drawings.

BRIEF DESCRIPTION OF THE DRAWINGS

FIG. 3 is an isometric view of a frame for mounting the sunshade attachment of FIG. 1 to cover a blanket or the like.

DETAILED DESCRIPTION OF THE INVENTION

Figure 1:
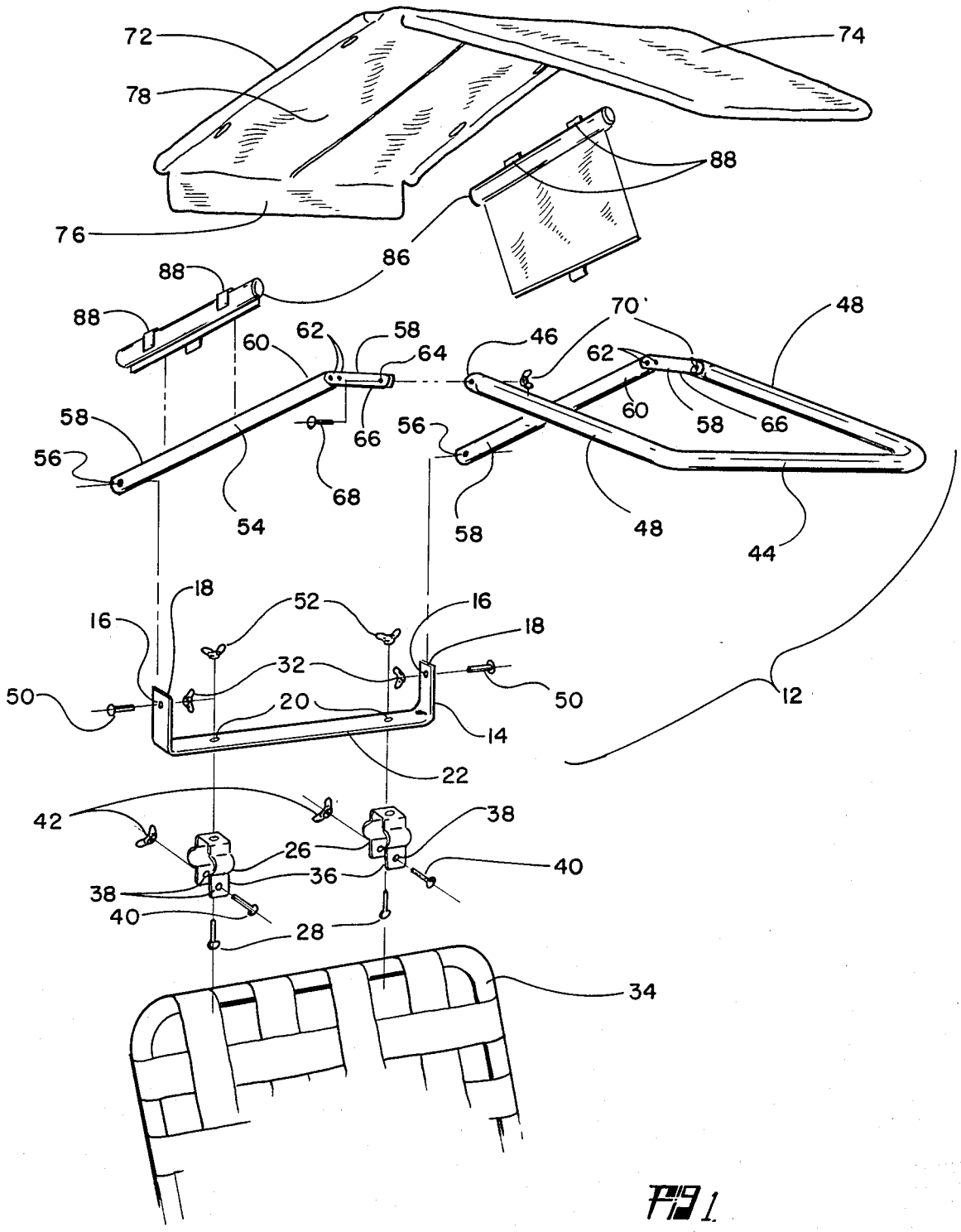
FIG. 1 is an exploded view of a sunshade attachment embodying the present invention.

In that form of the present invention chosen for purposes of illustration in the drawings, FIG. 1 shows a sunshade attachment, indicated generally at 12, having a first generally U-shaped member 14 formed with a first pair of holes 16 located adjacent the ends of the upturned side pieces 18 and a second pair f holes 20 spaced apart along the central portion 22 of the U-shaped member 14. A pair of clamps 26 are secured to the central portion 22 of the U-shaped member 14 by suitable means, such as bolts 28, which pass through holes 30 in the clamps 26 and through holes 20 in the central portion 22 of the U-shaped member 14 and are secured in place by suitable means, such as wing nuts 32. The clamps 26 serve to mount the sunshade attachment 12 on a crossbar, such as that seen at 34 in FIG. 1, which may be the top of a chair, chaise lounge or the like, or a crossbar mounted on a golf cart, wheel chair or other desired device where shade is desired. To attach the sunshade attachment 12 to the crossbar 34, the free ends 36 of the clamps 26 are provided with holes 38 to receive bolts 40 which are secured by suitable means, such as wing nuts 42 to cause the clamps 26 to grip the crossbar 34. Obviously, forward and rearward tilting of the sunshade attachment 12 can be accomplished by loosening the wing nuts 42, tilting the first U-shaped member 14 to a desired position and retightening the wing nuts 42.

A second generally U-shaped member 44 is provided having holes 46 located adjacent the ends of the side pieces 48 of the second U-shaped member 44. If the area to be shaded is relatively short, such as a chair, side pieces 48 of the second U-shaped member 44 may be attached directly to the side pieced 18 of the first U-shaped member 14 by suitable means, such as bolts 50, passing through holes 16 in the side pieces 18 of the first U-shaped member 14 and through holes 46 in the side pieces 48 of the second U-shaped member 44 and being secured by suitable means, such as wing nuts 52. Where the area to be shaded is longer, such as a chaise lounge, intermediate members 54 may be interposed between the first U-shaped member 14 and the second U-shaped member 44. As seen in FIG. 1, the intermediate members 54 are each generally straight pieces having holes 56 formed in one end 58 thereof and having extensions 58 fixedly secured to the opposite ends 60 thereof, as by rivets 62, and holes 64 are formed adjacent the free ends 66 of the extensions 58. To insert the intermediate members 54 between the first U-shaped member 14 and the second U-shaped member 44, bolts 50 are passed through holes 16 in the side pieced 18 of the first U-shaped member 14 and through holes 56 in ends 58 of the intermediate members 54 and are secured by wing nuts 52. Thereafter, bolts 68 are passed through holes 46 in the side pieces 48 of the second U-shaped member 44 and through holes 64 in the free ends 66 of the extensions 58 of the intermediate members 54 and are secured by suitable means, such as wing nuts 70. It will be apparent to those skilled in the art that the tilting positions of the second U-shaped member 44 and the intermediate members 54 may be adjusted, substantially as desired, by loosening the appropriate wing nuts 52 or 70, placing the second U-shaped member 44 and the intermediate members 54 in the desired positions and retightening the appropriate wing nuts 52 or 70.

Figure 2:
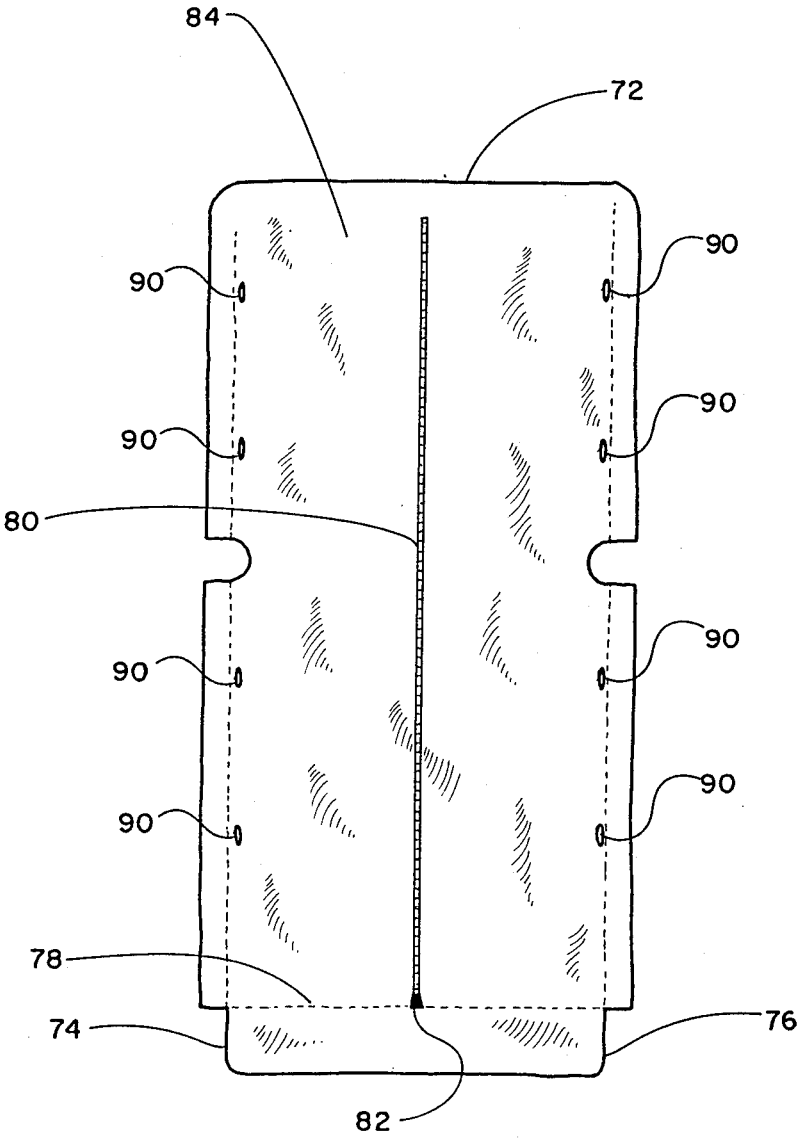
FIG. 2 is a bottom view of the canopy of the sunshade attachment of FIG. 1.

To provide the desired shade, a canopy 72 is provided which is slideably mountably on the sunshade attachment 12. As best seen in FIG. 2, the canopy 72 is an envelope-like member of suitable opaque material, such as canvas, plastic or the like, and is formed with a top layer 74 that will extend the full length of both the second U-shaped member 44 and the intermediate members 54 and will have a flap portion 76 which will hang downwardly adjacent the first U-shaped member 14 to provide sunshade protection for the user's back. The canopy 72 also has a bottom layer 78 which is shorter that the top layer 74, by the length of the flap portion 76, and is provided with a longitudinal slit 80 which is closable by suitable means, such as a zipper 82. When the sunshade attachment 12 is used, without the intermediate members 54, to provide shade for a chair or the like, the forward portion of the canopy 72, indicated generally at 84, will be supported by the second U-shaped member 54, while the remainder of the canopy 72, including flap 76, will hang downwardly at the rear of the sunshade attachment 12 to provide shade for the user's back. If the intermediate members 54 are mounted, the canopy 72 will be supported by the intermediate members 54, as well as be the second U-shaped member 44, and only the flap 76 will provide protection for the user's back.

To provide lateral protection against the sun coming from low angles at the side, a pair of coil-type shades 86 are provided having clip means 88 for mounting the coil-type shades 86 on the sunshade attachment 12. The coil-type shades 86 can be unreeled to provide protection against sunlight coming in from the side or to provide a degree of privacy for the user, and can be rewound, when desired, for storage. The clips 88 can be mounted on the side pieces 48 of the second U-shaped member 44, when the sunshade attachment 12 is adapted for use with a chair or the like, or may be mounted on the intermediate members 54, when the sunshade 12 is adapted for use with a chaise lounge or the like. As best seen in FIG. 2, the bottom layer 78 of the canopy 72 is formed with slits 90 spaced along the side edges thereof to permit the clips 88 of the coil-type shades 86 to pass through the bottom layer 78 of the canopy 72 to mount on either the intermediate members 54 or the side pieces 48 of the second U-shaped member 44.

Figure 3:
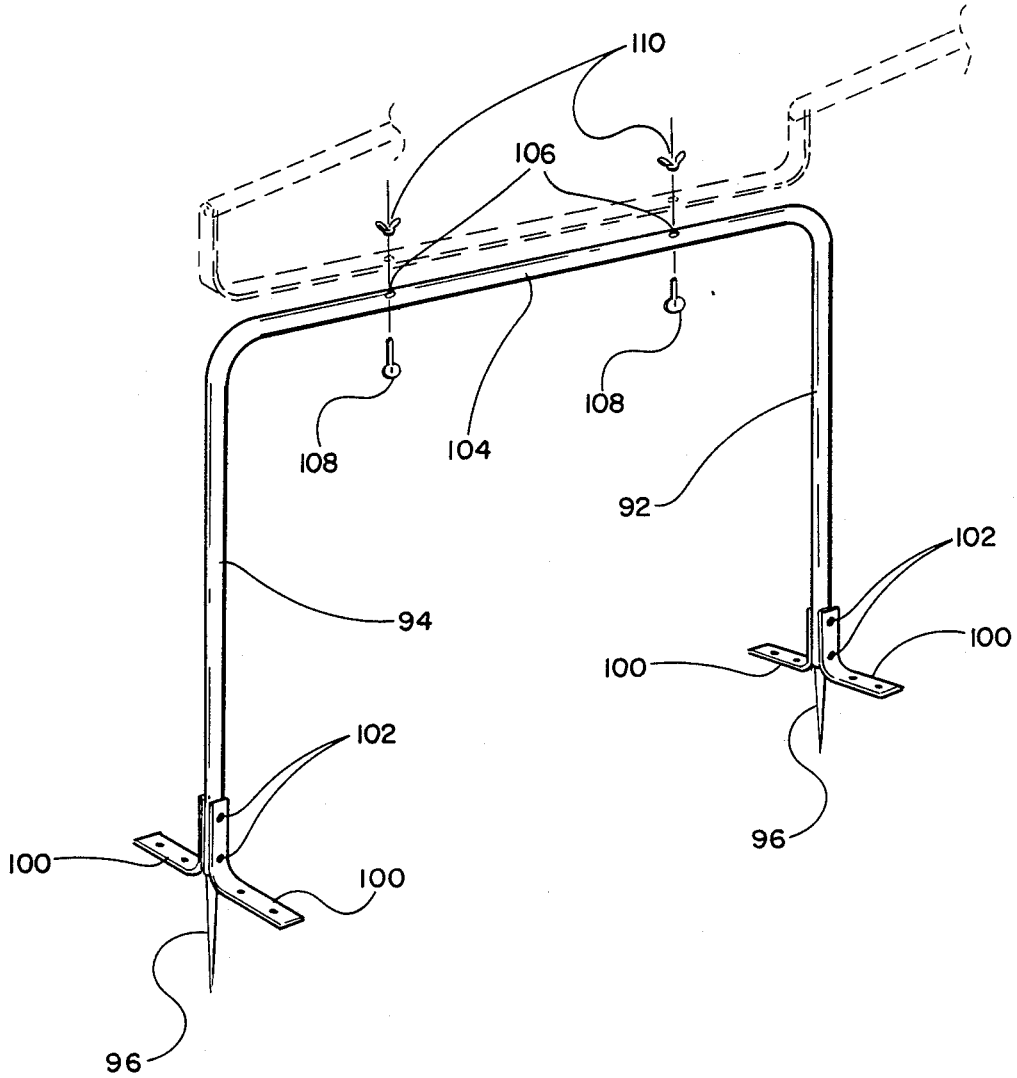

FIG. 3 shows a frame 92 for mounting the sunshade attachment 12 on the ground to cover a blanket air mattress or the like. The frame 92 comprises a generally U-shaped member 94, preferably formed of tubular material, having spike means 96, mounted in the ends of the side pieces 98 of the U-shaped member 94, to facilitate ground penetration to maintain the frame 92 in a substantially vertical position. A pair of right-angle members 100 are secured adjacent the ends of each of the side pieces 98 of the U-shaped member 94 by suitable means, such as rivets 102, to prevent excessive ground penetration, especially in soft material, such as sand. Clamps 26 of the sunshade attachment 12 may be secured to the crossbar 104 to mount the sunshade attachment 12 on the ground frame 92. Alternatively, holes 106 may be formed in the crossbar 104 and suitable means, such as nuts 108, may be passed through the holes 106 in frame 92 and through holes 20 in the central portion 22 of the first U-shaped member 14 of sunshade attachment 12 to mount the sunshade attachment 12 on the frame 92 and can be secured by suitable means, such as wing nuts 110.

It will be apparent to those skilled in the art that the second U-shaped member 44 may, if desired, be formed of tubular material. Moreover, if desired, the spike means 96 could be omitted from frame 92 and holes could be provided in the free ends of the angle members 100 to permit the frame 92 to be bolted or otherwise mounted on a golf cart, wheel chair, boat, wooden bench or substantially any desired structure. In addition, numerous other variations and modifications could be made without departing from the spirit of the present invention. Therefore, it should be clearly understood that the forms of the present invention described above and shown in the accompanying drawings is illustrative only and is not intended to limit the scope of the present invention.

I claim:

1. A sunshade attachment comprising:

a first generally U-shaped member, a pair of clamps mounted on said first U-shaped member for releasably attaching said first U-shaped member to a desired structure, a second generally U-shaped canopy supporting member releasably attachable to said first U-shaped member, a canopy formed of opaque material covering said members, and means for releasably securing said members together.

2. The sunshade attachment of claim 1 further comprising:

a pair of side arms interposable between said first and second U-shaped members.

3. A sunshine attachment comprising:

a first generally U-shaped member, a pair of clamps for releasably attaching said first U-shaped member to a desired structure, a second generally U-shaped canopy supporting member releasably attachable to said first U-shaped member, a canopy formed of opaque material covering said members, means for releasably securing said members together, and at least one coil-type shade formed with clip means for releasably mounting said coil-type shade on the side pieces of said second U-shaped member and extensible to provide lateral protection and privacy.

4. The sunshade attachment of claim 2 wherein:

said canopy comprises:

a top layer extending the length of said second U-shaped member and said side arms and having a rear flap extending over said first U-shaped member, and a bottom layer extending the length of said second U-shaped member and said side arms and formed with a longitudinal slit extending at least the length of said side arms and having closure means releasably joining the edges of said slit.

5. The sunshade attachment of claim 1 further comprising:

a generally U-shaped supporting member, spike means extending from the ends of the side pieces of said supporting member, and a pair of right angle members fixedly mounted to the ends of the side pieces of said supporting member.

6. The sunshade attachment of claim 1 wherein:

said releasable securing means are bolts and wing nuts.

7. The sunshade attachment of claim 1 wherein:

said canopy comprises:

a top layer extending the length of said second U-shaped member and having a rear flap extending over said first U-shaped member, and a bottom layer extending the length of said second U-shaped member and formed with a longitudinal slit extending the length of the side arms of said second U-shaped member and having closure means releaseably joining the edges of said slit.

* * * * *